US011014106B2

(12) United States Patent
Tortosa Maroto

(10) Patent No.: US 11,014,106 B2
(45) Date of Patent: May 25, 2021

(54) DISPENSER DEVICE FOR LIQUIDS

(71) Applicant: DISARP, S.A., Daimuz (ES)

(72) Inventor: Miguel Angel Tortosa Maroto, Gandia (ES)

(73) Assignee: DISARP, S.A., Daimuz (ES)

( * ) Notice: Subject to any disclaimer, the term of this patent is extended or adjusted under 35 U.S.C. 154(b) by 0 days.

(21) Appl. No.: 16/578,302

(22) Filed: Sep. 21, 2019

(65) Prior Publication Data

US 2020/0122172 A1 Apr. 23, 2020

(51) Int. Cl.

| | |
|---|---|
| ***B05B 9/08*** | (2006.01) |
| ***B65D 77/06*** | (2006.01) |
| *B05B 11/00* | (2006.01) |

(52) U.S. Cl.

CPC ..... *B05B 9/085* (2013.01); *B65D 77/06* (2013.01); *B05B 11/00412* (2018.08); *B05B 11/3011* (2013.01); *B05B 11/3043* (2013.01)

(58) Field of Classification Search

CPC ..... B05B 9/085; B05B 11/3043; B05B 11/00412; B05B 11/3011; B65D 77/06; B65D 77/00–40

See application file for complete search history.

(56) References Cited

U.S. PATENT DOCUMENTS

| | | | | |
|---|---|---|---|---|
| 2,816,691 A | | 12/1957 | Ward | |
| 3,731,854 A | | 5/1973 | Casey | |
| 5,004,123 A | * | 4/1991 | Stoody | B05B 11/00412 222/94 |
| 5,156,299 A | * | 10/1992 | De Caluwe | B05B 11/00412 222/82 |
| 5,474,212 A | * | 12/1995 | Ichikawa | B05B 11/0043 222/105 |
| 6,142,344 A | * | 11/2000 | Kai | B65D 75/5883 222/105 |
| 6,510,965 B1 | * | 1/2003 | Decottignies | B05B 11/00412 222/95 |
| 10,005,222 B2 | * | 6/2018 | Corbett | B29C 49/0047 |
| 2006/0255072 A1 | | 11/2006 | Hagin et al. | |
| 2007/0023458 A1 | * | 2/2007 | Bargo | B67D 1/0456 222/416 |

(Continued)

FOREIGN PATENT DOCUMENTS

| | | |
|---|---|---|
| EP | 0447687 | 9/1991 |
| WO | WO 2013/036695 | 3/2013 |

*Primary Examiner* — Vishal Pancholi
*Assistant Examiner* — Bob Zadeh
(74) *Attorney, Agent, or Firm* — Horst M. Kasper, Esq

(57) ABSTRACT

Dispenser device for liquids, comprising: —a dispenser head (1); —a replaceable, flexible receptacle (2), containing the liquid to be dispensed and which has a valve (21) provided with a seal (22) for opening and closing; —a rigid container (3) for securing the flexible receptacle, provided with a mouth (32) for the mechanical coupling of the dispenser head (1) and of means (33) for the coupling and securing of the valve (21) of the flexible receptacle (2) in a position facing the mouth (32) of the rigid container (3); and —a hydraulic coupling part (4) of the dispenser head to the flexible receptacle, which is automatically coupled to and decoupled from the seal (22) of the valve (21) and displaces it towards an open position and towards a closed position when the dispenser head (1) is coupled to and decoupled from the rigid container (3), respectively.

4 Claims, 4 Drawing Sheets

(56) References Cited

U.S. PATENT DOCUMENTS

| | | | | |
|---|---|---|---|---|
| 2008/0314475 | A1* | 12/2008 | Fransen | B65D 83/62 141/20 |
| 2010/0252573 | A1* | 10/2010 | Hetmaniok | B05B 11/0054 222/105 |
| 2015/0314916 | A1* | 11/2015 | Corbett | B65D 25/16 220/495.03 |
| 2016/0023811 | A1* | 1/2016 | Fellin | B65D 43/22 220/574 |
| 2017/0283158 | A1* | 10/2017 | Schulz | B65D 83/48 |
| 2020/0122172 | A1* | 4/2020 | Tortosa Maroto | B05B 9/085 |

* cited by examiner

DISPENSER DEVICE FOR LIQUIDS

FIELD OF THE INVENTION

The present invention relates to a dispenser device for liquids comprising means containing the liquid to be dispensed and a dispenser head provided with means of mechanical and hydraulic coupling to said means containing the liquid.

This dispenser device for liquids is applicable in the packaging field, of hygiene and cleaning products, although its use in the packaging of any other liquid is not dismissed.

PRIOR ART

There currently exists on the market a multitude of dispenser devices for the packaging and marketing of hygiene or cleaning liquids, which have a rigid plastic receptacle provided with a mouth for the coupling of a dispenser head, which on being manually actuated suctions the product through a tube and sprays it supplying it in the form of small drops.

This type of receptacles is widely used for packaging cleaning products since they allow diffusing a relatively small quantity of liquid on the surface to be cleaned.

These cleaning products are marketed with the receptacle, provided with the corresponding dispenser head, and when it is finished both the receptacle and dispenser head are discarded, which entails a high environmental impact due to the volume of waste generated.

Therefore, the technical problem considered is the development of a dispenser device for liquids which, comprising a dispenser head and liquid container means, it allows reusing the head, only discarding the product containing receptacle and, additionally, using a type of product containing receptacle of less volume and which, when discarded, causes less environmental impact than the receptacles currently used.

EXPLANATION OF THE INVENTION

To resolve the aforementioned problems, the dispenser device for liquids object of this invention has been devised, comprising: on the one hand, a flexible and replaceable receptacle, bag-type containing the liquid to be dispensed and, on the other hand, a rigid container for the support of a replaceable flexible receptacle and a dispenser head which can be mechanically coupled to said rigid container, and hydraulically to the flexible receptacle positioned inside the rigid container.

This allows the user to be able to reuse both the dispenser head and the rigid container, only acquiring the flexible receptacle containing the product to be dispensed, with the consequent reduction in environmental impact, since the volume occupied by rigid receptacles is much greater than that of flexible receptacles.

According to the invention, said flexible and replaceable receptacle, bag-type, has a valve provided with a seal displaceable between an open position and a position of hermetic closure, which allows removing at any time the flexible bag from the dispenser and this automatically closes, keeping the liquid remaining therein until its next use.

The rigid container used for the support of the flexible receptacle is provided with: an opening for inserting the flexible receptacle therein; a mouth provided with means for the mechanical coupling of the dispenser head, and means for the detachable coupling and the securing of the valve of the flexible receptacle in a position facing the mouth of the rigid container.

These characteristics allow, once the dispenser head has been decoupled from the rigid container, that the flexible receptacle can be mounted and detached in said rigid container repetitively, or replace it for a new one in the event the liquid contained therein has finished.

This dispenser device comprises a hydraulic coupling part of the dispenser head to the flexible receptacle, said coupling part being provided with an internal orifice for the passage of liquid and an end appendage for the actuation of the valve seal.

Said end appendage is automatically coupled to the valve seal and displaces it towards an open position when said dispenser head is mechanically coupled to the mouth of the rigid container; and displaces the seal towards the position of hermetic closure of the valve, releasing it when the dispenser head is decoupled from the rigid container.

These and other characteristics of the invention shall be more easily understood in light of an example of embodiment that is shown in the attached figures described below.

BRIEF DESCRIPTION OF CONTENT OF THE DRAWINGS

To complement the description being made and in order to aid towards a better understanding of the characteristics of the invention, a set of drawings is attached as an integral part of the present specification wherein, with illustrative and non-limiting character, the following has been represented.

DETAILED EXPLANATION OF EMBODIMENTS OF THE INVENTION

Figure 1:
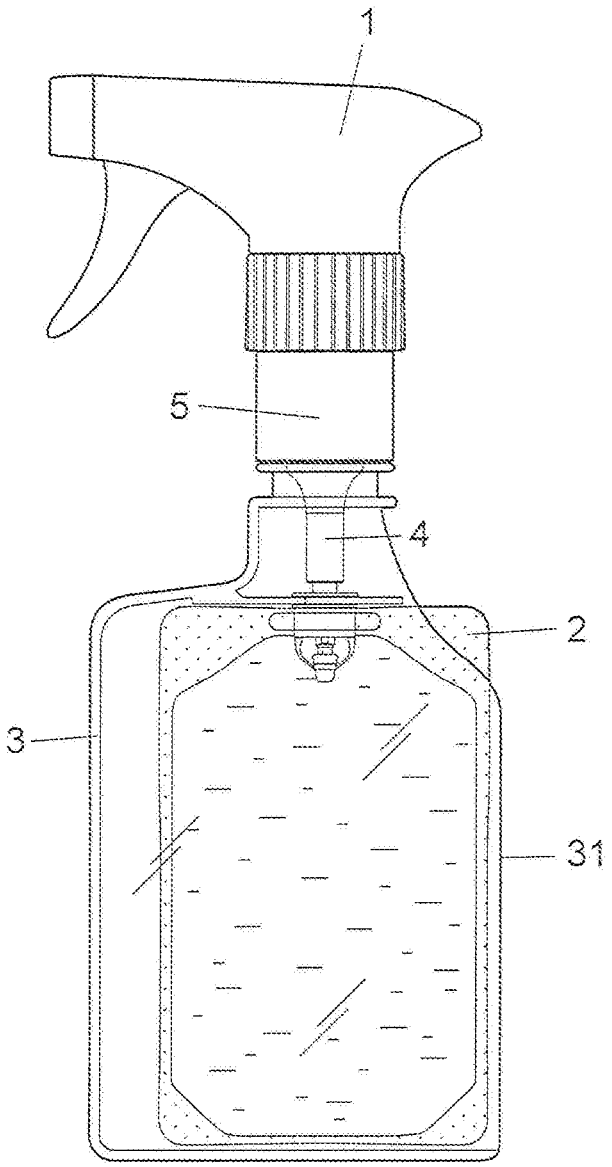
FIG. 1 shows an elevational view of the dispenser device for liquids totally assembled, in position of use.
Figure 2:
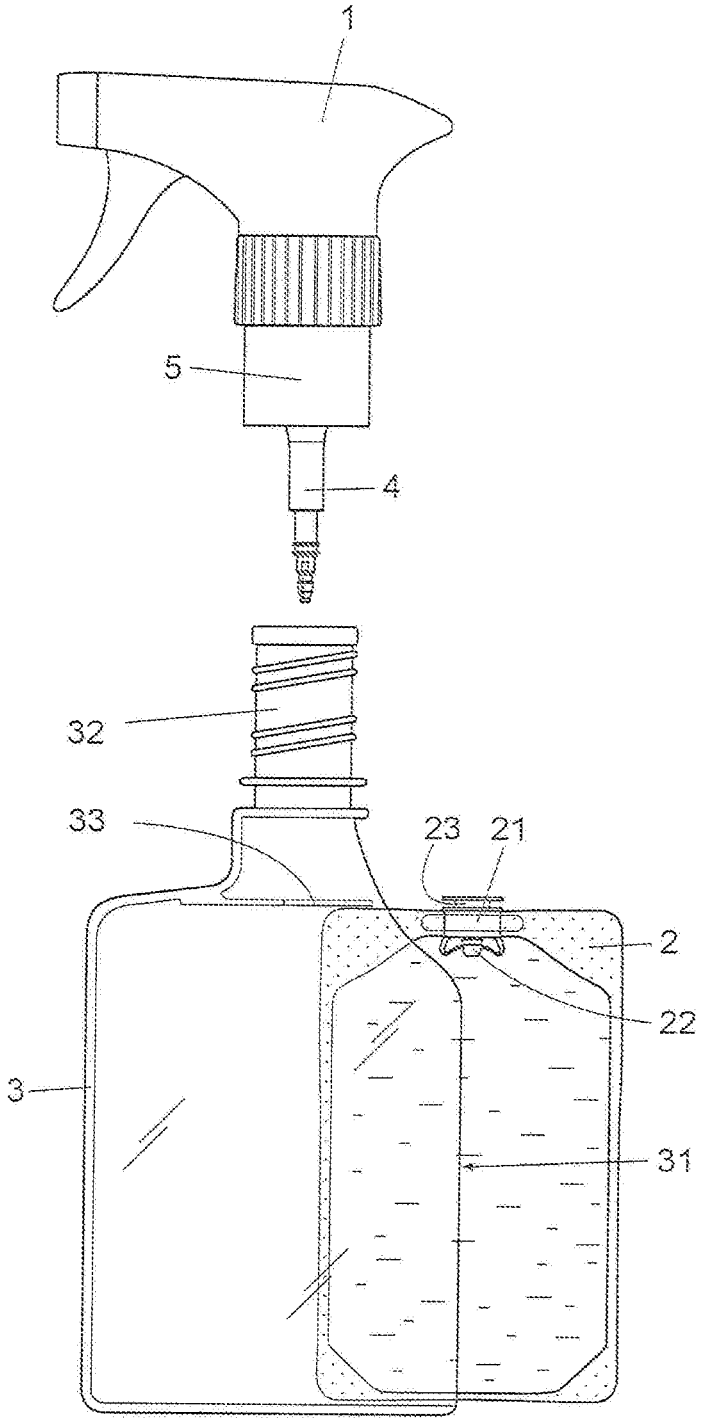
FIG. 2 shows an elevational view of the dispenser device of the previous figure with the dispenser head detached from the rigid container and the flexible liquid containing receptacle laterally removed from said rigid container.

As can be observed in FIGS. 1 and 2, the dispenser device for liquids comprises: a dispenser head (1), formed in this case by a spray head of manual actuation; a replaceable, flexible receptacle (2), bag-type, containing the liquid to be dispensed; a rigid container (3) suitable for the securing of the flexible receptacle (2) in a position of use, represented in FIG. 1, and a hydraulic coupling part (4) of the dispenser head (1) to the flexible receptacle.

Figure 6:
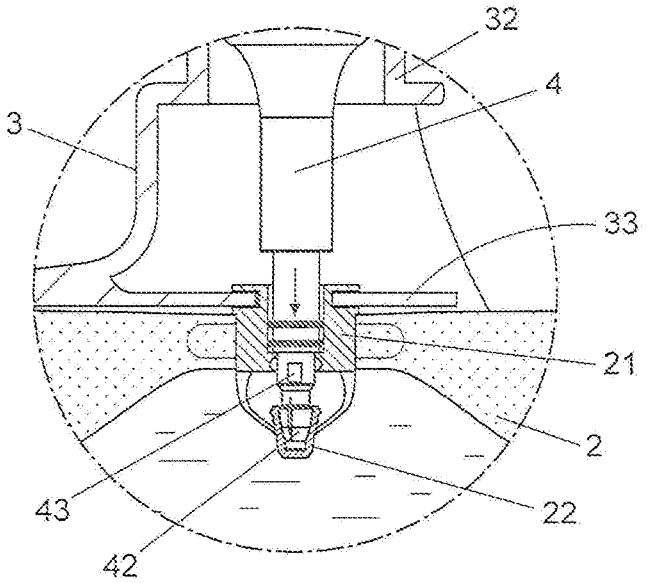
FIGS. 6 and 7 show different elevational details of the displacement of the valve seal towards the open and closed positions by action of the hydraulic coupling part of the dispenser head.
Figure 7:
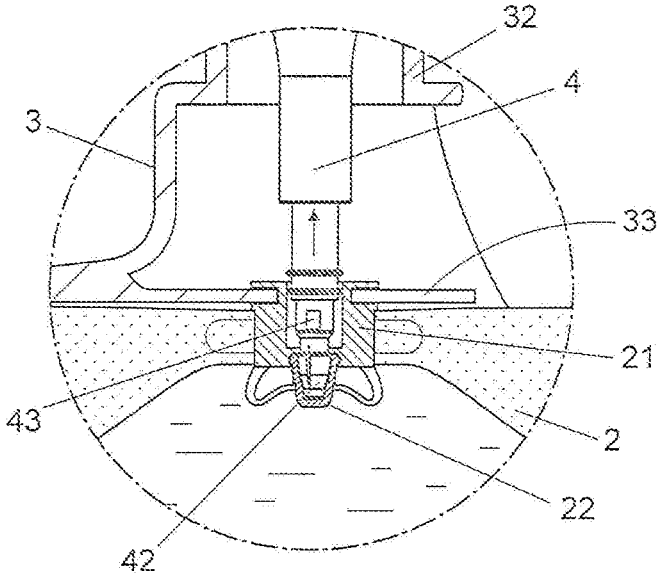

Said flexible receptacle has a valve (21) provided with a seal (22) displaceable between an open position shown in FIG. 6 and a closed position shown in FIG. 7.

The rigid container (3) has: an opening (31) for the introduction and extraction of a flexible receptacle (2) therein; a mouth (32), threaded, visible in FIG. 2 and suitable for the mechanical coupling of the dispenser head (1); and means for the detachable coupling and the securing of the valve (21) of the flexible receptacle (2) in a position facing the mouth (32) of said rigid container.

In the example shown, the opening (31) for inserting the flexible receptacle (2) in the rigid container is defined in one side of said rigid container and open in a direction perpendicular to the mouth (32) thereof.

Figure 3:
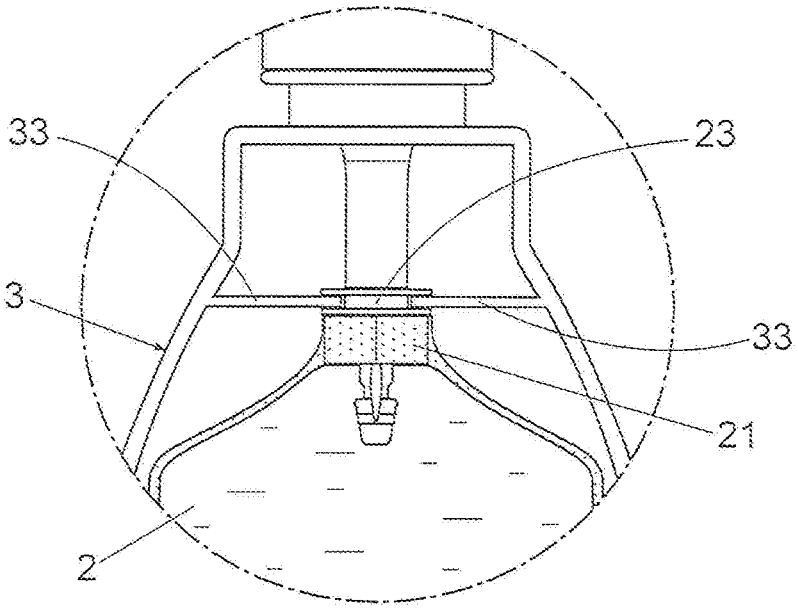
FIG. 3 shows a partial view of the profile of FIG. 1, wherein it is possible to observe the means defined in the rigid container for the detachable coupling from the flexible receptacle.

In the detail of FIG. 3, the means defined in the rigid container (3) for the detachable coupling and the securing of the valve (21) of the flexible receptacle (2) inside said rigid container, comprise two parallel ribs (33), facing the opening (31) for inserting the flexible receptacle (2) in the rigid container (3) and suitable for being housed in a perimeter channel (23) defined for said purpose in the valve (21) of the flexible receptacle (2).

Figure 4:
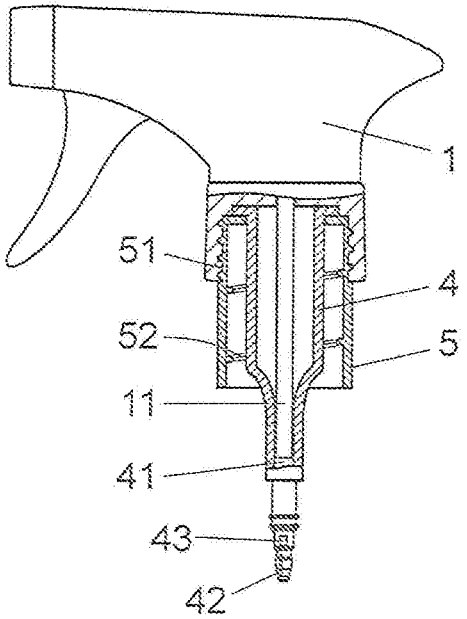
FIG. 4 shows an elevational and partially sectional view of the dispenser head, wherein the assembly therein of the hydraulic coupling part designed to be coupled to the flexible receptacle can be observed.
Figure 5:
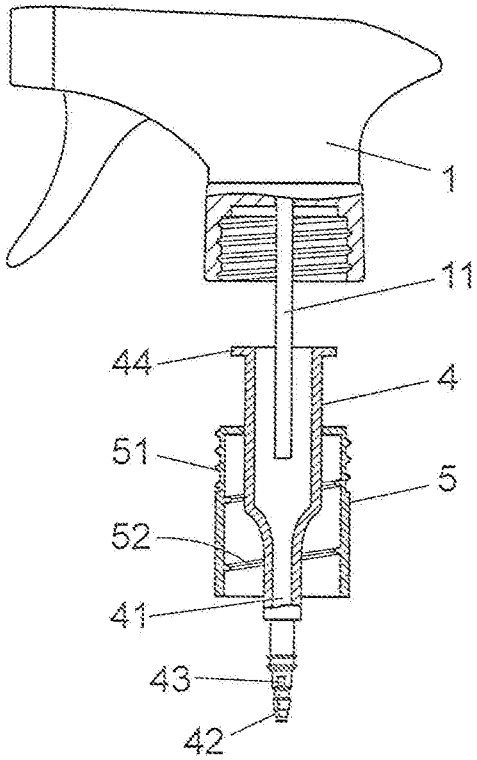
FIG. 5 shows a similar view to the previous one with the hydraulic coupling part and the tubular securing neck thereof in a detached position.

As can be observed in greater detail in FIGS. 4 and 5, the hydraulic coupling part (4) of the dispenser head (1) to the flexible receptacle (2) is provided with an internal orifice (41) for the passage of liquid and an end appendage (42), elastically deformable to be coupled to and decoupled from, simply by pressure, the seal (22) of the valve (21) of the flexible receptacle (2).

The dispenser head (1) has a flexible tube (11) of liquid intake, coupled to the internal orifice (41) of the hydraulic coupling part (4).

The internal orifice (41) of the hydraulic coupling part (4) is open, by windows (43), positioned above the end appendage (42), for the liquid intake of the flexible receptacle in the position of use of the dispenser device.

In the example shown, said hydraulic coupling part (4) is mechanically fixed to the dispenser head (1) by a tubular neck (5) provided with a thread (51) for its mounting on the dispenser head (1), said tubular neck (5) pressing a proximal thickening (44) of the hydraulic coupling part (4) against said dispenser head (1).

This tubular neck (5) also has a thread (52) for the mechanical securing of the dispenser head (1) to the mouth (32) of the rigid container (3).

As shown in FIG. 6, the end appendage (42) of the hydraulic coupling part (4) is automatically coupled to the seal (22) and displaces it towards an open position when the dispenser head (1) is mechanically coupled to the mouth (32) of the rigid container (3).

In this open position, the liquid contained in the flexible receptacle (2) accesses the inside of the hydraulic coupling part (4) with the head through the windows (43) of said hydraulic coupling part.

Said end appendage (42) of the hydraulic coupling part displaces the seal (22) towards the position of hermetic closure of the valve (21) of the flexible receptacle (2) as shown in FIG. 7 and is released therefrom when the dispenser head (1) is mechanically decoupled from the mouth (32) of the rigid container (3).

In the example shown, the dispenser head (1) is a spray head of manual actuation although it could be a dispenser head of any other type since this does not affect the essence of the invention.

Having sufficiently described the nature of the invention, and an example of practical embodiment, it should be stated for the appropriate purposes that the materials, form, size and layout of the elements described can be modified, provided they do not involve an alteration of the essential characteristics of the invention claimed below.

The invention claimed is:

1. Dispenser device for liquids, comprising: means containing the liquid to be dispensed formed by a flexible and replaceable receptacle (2), bag-type, containing the liquid to be dispensed; a dispenser head (1) provided with means of mechanical and hydraulic coupling to said means containing the liquid and which is an atomizer or spray head of manual actuation; a rigid container (3) for securing the flexible receptacle, provided with a mouth (32) for the mechanical coupling of the dispenser head (1); characterized in that: the flexible receptacle (2) has a valve (21) provided with a seal (22) displaceable between an open position and a position of hermetic closure of said flexible receptacle (2); the rigid container (3), of support of the flexible receptacle (2), is provided with: an opening (31) for inserting the flexible receptacle (2) therein, defined in one side of said rigid container (3) and open in a direction perpendicular to the mouth (32) of said rigid container (3); means (33) for the detachable coupling and the securing of the valve (21) of the flexible receptacle (2) in a position facing the mouth (32) of the rigid container (3); and in that the dispenser device comprises a hydraulic coupling part (4) of the dispenser head (1) to the flexible receptacle (2), provided with an internal orifice (41) for the passage of liquid and an end appendage (42) which is automatically coupled to the seal (22) of the valve (21) and displaces it towards an open position, when said dispenser head (1) is mechanically coupled to the mouth (32) of the rigid container (3), and which displaces the seal (22) towards a position of hermetic closure of the valve and is released therefrom when the dispenser head (1) is decoupled from the mouth (32) of the rigid container (3); said internal orifice (41) being open by windows (43), positioned above the end appendage (42), for a liquid intake of the flexible receptacle (2) in a position of use of the dispenser device.

2. Dispenser device, according to claim 1, characterized in that the hydraulic coupling part (4) is mechanically fixed to the dispenser head (1) by means of a tubular neck (5) provided with a thread (51) mounted on the dispenser head (1) of a thread (52) mechanically secured to the mouth (32) of the rigid container (3), and which presses a proximal thickening (44) of said hydraulic coupling part (4) against the dispenser head.

3. Dispenser device, according to claim 1, characterized in that the dispenser head (1) has a flexible tube (11) of the liquid intake, coupled to the internal orifice (41) of the hydraulic coupling part (4) to the flexible receptacle (2).

4. Dispenser device, according to claim 1, characterized in that the means defined in the rigid container (3) for the detachable coupling and the securing of the valve (21) of the flexible receptacle (2) comprise two parallel ribs (33) facing the opening (31) for inserting the flexible receptacle (2) and suitable for being housed in a perimeter channel (23) of the valve (21) of the flexible receptacle (2).

* * * * *